United States Patent [19]

Cotic et al.

[11] Patent Number: 4,974,518

[45] Date of Patent: Dec. 4, 1990

[54] AUTOMATIC TIE PLATE SETTING MACHINE

[75] Inventors: Dennis J. Cotic, Waukesha; John L. Thorson, Wauwatosa, both of Wis.

[73] Assignee: Oak Industries, Inc., San Diego, Calif.

[21] Appl. No.: 226,761

[22] Filed: Aug. 1, 1988

[51] Int. Cl.[5] ..... E01B 29/32

[52] U.S. Cl. ..... 104/16; 198/394; 198/395; 209/541

[58] Field of Search ..... 104/16, 2, 5, 307; 198/394, 395, 398, 524, 530, 535, 536; 193/44; 209/625, 626, 682, 540, 541, 542, 545

[56] References Cited

U.S. PATENT DOCUMENTS

| | | | |
|---|---|---|---|
| 3,361,246 | 1/1968 | Kukawski | 198/394 |
| 3,433,966 | 3/1969 | Letch et al. | 250/223 |
| 3,730,325 | 5/1973 | Goodwin | 198/395 |
| 3,882,785 | 5/1975 | Rowe | 104/16 |
| 3,943,858 | 3/1976 | Dieringer et al. | 104/16 |
| 4,178,671 | 12/1979 | Luttig | 29/429 |
| 4,241,663 | 12/1980 | Lund et al. | 104/16 |
| 4,280,613 | 7/1981 | Stewart | 198/406 |
| 4,393,784 | 7/1983 | Theurer | 104/2 |
| 4,478,152 | 10/1984 | Holley | 104/307 |
| 4,502,590 | 3/1985 | Pole | 198/611 |
| 4,691,639 | 9/1987 | Holley | 104/16 |
| 4,727,989 | 3/1988 | Cotic et al. | 209/546 |

FOREIGN PATENT DOCUMENTS

| | | | |
|---|---|---|---|
| 433627 | 9/1926 | Fed. Rep. of Germany | 104/16 |
| 57627 | 5/1967 | German Democratic Rep. | 198/394 |
| 308954 | 3/1969 | Sweden | 310/198 |
| 386049 | 10/1973 | U.S.S.R. | 104/16 |
| 509398 | 4/1976 | U.S.S.R. | 313/398 |
| 644897 | 1/1979 | U.S.S.R. | 104/16 |
| 652257 | 3/1979 | U.S.S.R. | 104/16 |
| 765445 | 9/1980 | U.S.S.R. | 104/16 |
| 12995 | of 1914 | United Kingdom | 209/682 |
| 2171379 | 8/1986 | United Kingdom | 198/395 |

OTHER PUBLICATIONS

"An Attraction for OTM", Railway Track and Structures, Mar. 1986, pp. 29–31.

*Primary Examiner*—Andres Kashnikow
*Assistant Examiner*—C. Trainor
*Attorney, Agent, or Firm*—Welsh & Katz, Ltd.

[57] ABSTRACT

A machine for automatically setting rail tie plates includes a frame adapted to be propelled along a rail bed having one or both rails removed, the frame including a hopper adapted to store a plurality of randomly oriented plates therein, a crane for transferring plates to a plate sorting conveyor which sorts the plates as to specified length-to-width orientation and deposits the oriented plates upon an inclined conveyor where they are sensed as to specified top-to-bottom orientation, with improperly oriented plates being automatically inverted; the sensed and inverted plates are then manually disposed as to proper high-to-low side orientation, from where they are stored for eventual automatic deposition upon the tie by a reciprocating pusher assembly.

43 Claims, 4 Drawing Sheets

FIG-4-
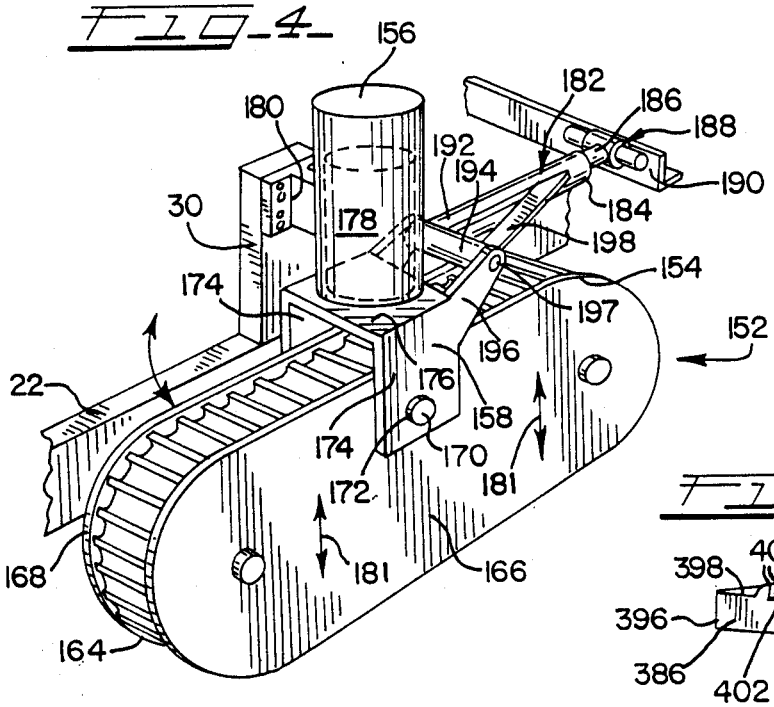
FIG-3-
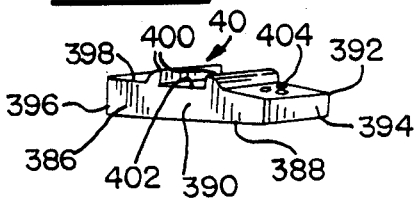
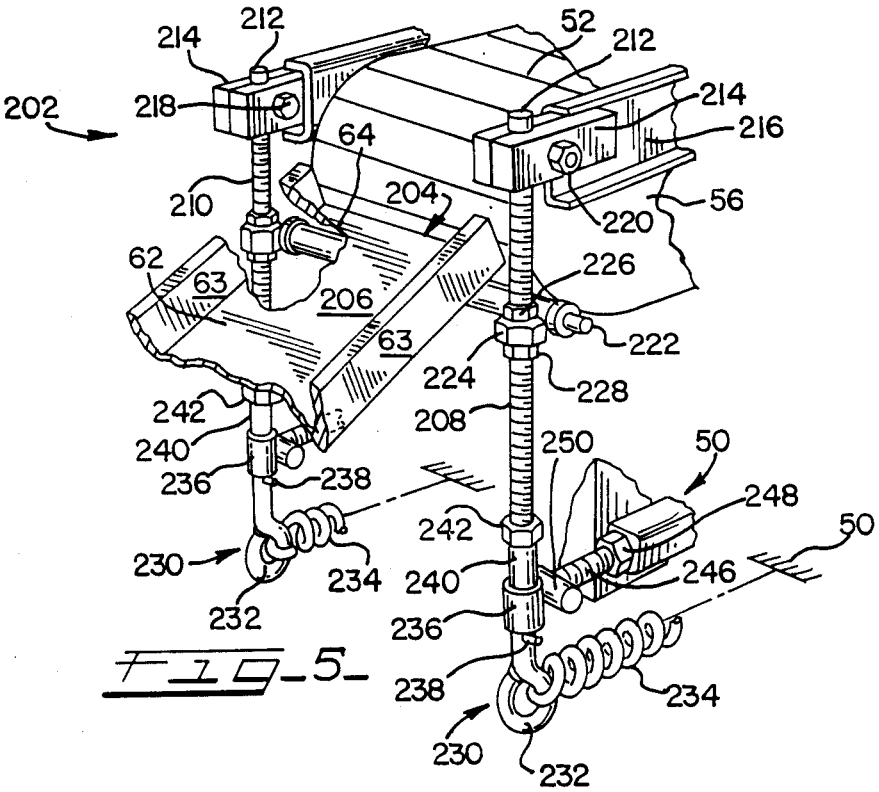
FIG-5-

AUTOMATIC TIE PLATE SETTING MACHINE

RELATED APPLICATIONS

The invention disclosed in the present application is related to the invention disclosed in my co-pending application Ser. No. 203,328, filed June 7, 1988, titled "Method and Apparatus for Automatically Setting Rail Tie Plates", co-pending application Ser. No. 203,486, filed June 7, 1988, titled "Automatic Tie Plate Sorting Conveyor", copending Ser. No. 224,486 filed July 26, 1988, titled "Automatic High Speed Tie Plate Reorienting Mechanism," as well as U.S. Pat. No. 4,727,989 issued Mar. 1, 1988, titled "Automatic Tie Plate Orientation Sensing System," the contents of which are incorporated by reference herein.

BACKGROUND OF THE INVENTION

The present invention relates to machines for repairing or reconditioning railroad rights-of-way and more specifically relates to a machine adapted to orient randomly stored rail tie plates in a specified length-to-width, top-to-bottom and high side-to-low side orientation and to transport the oriented plates for subsequent accurate placement thereof upon railroad ties.

Tie plates are used to secure rails to railroad ties and comprise a generally flat steel plate with a substantially flat bottom, a plurality of spike holes located side ends of the plate, and an upper surface having a pair of parallel, vertically projecting rail securing ribs or shoulders which define a rail seat therebetween. The tie plate upper surface is slightly angled to provide an inwardly canted rail seat, with more mass located on the field or "high" side of the plate to compensate for the force distribution of trains negotiating curves at high speed.

In the process of reconditioning railroad rights-of-way, the existing rail is removed along with the spikes and tie plates, the ties are replaced or resurfaced, and the track bed or ballast is refurbished. Before new rails are laid, replacement or recycled tie plates must be accurately positioned upon the ties.

Tie plate replacement is a cumbersome and labor-intensive operation, due to the significant weight of the individual plates (18–40 lbs. each) and the rapid rate at which they must be positioned to keep up with the other operations of track reconditioning, most of which are largely automated. Normally a member of a plate handling crew must retrieve steel plates individually from an often tangled pile and properly orient each plate for setting upon the upper surface of a tie to form new track beds. Two hands are required to position each plate due to their size and significant weight. If the plate is inverted, a worker must get his fingers under the plate and turn it over. Typically this is done on the ground or on a steel table often surrounded by other plates and track material. Accurate plate placement is critical, for the plates are required to be positioned within ¼ inch on an imaginary x-y plane parallel to the ground. The configuration of the plates is such that the shoulders must be facing upwardly, the planar surface must be on the bottom, and the larger or "field side" located outwardly for proper said placement thereon. It has been estimated that a member of a plate feeding crew will handle 150,000 pounds per 8 hour shift. In order for the manual plate setting operation to keep up with the other automated track reconditioning operations of the rail gang, the workers must lay plates at 30 to 40 plates per minute for maximum rail gang efficiency. Considering the relatively rapid rates of placement required, as well as the degree of accuracy required, operator effort and safety become major concerns.

Previous attempts at automating the tie plate setting operation often resulted in devices largely concerned with the actual placement of the plates upon the ties. These prior art setters often depend on a supply of plates which had already been manually oriented, either on or off-site. On-site, plates are pre-positioned along the shoulder of the track bed, or carried in a gondola to be fed via conveyors to the plate setting device. One such prior art mechanism employs a magnetic pick up wheel and conveyor to transport plates from the tracks shoulder to a hopper, when they are manually oriented and placed on a crawler chain carrier for deposition upon the ties. Regardless of the apparatus employed, the rapid rate of 30 to 40 plates per minute at which conventional tie plate setters must operate to keep up with other automated track maintenance equipment requires extensive preplacement and labor intensive manual handling and sorting of plates. In addition, prior art devices are capable of setting plates for only one rail at a time.

Thus, there is a need for an automatic tie plate setting machine capable of accurately and automatically setting plates at 30 to 40 plates per minute with a minimum of manual handling and sorting.

SUMMARY OF THE INVENTION

Accordingly, the automatic tie plate setting machine of the invention is designed to receive randomly oriented tie plates and to orient them in proper length-to-width, top-to-bottom and high side-to-low side orientation for subsequent accurate automatic placement of the plates upon the rail ties. The machine of the invention may set plates for either rail, or, if desired, both rails simultaneously.

The automatic rail tie plate setting machine of the invention is designed as a self-propelled unit which stores a plurality of randomly oriented plates and transports these stored plates to a sorting conveyer for automatic sorting as to a specified length-to-width orientation. The conveyor transports the sorted plates to an automatic sensor which determines the top-to-bottom orientation of the plates and triggers an automatic stop and flipper mechanism should such orientation be incorrect. The machine also provides for manual disposition as to specified high side-to-low side orientation. The sorted plates are then stored in a storage rack and are fed seriatim to a pocket of a reciprocating plate pusher mechanism. The pusher mechanism is adapted to automatically deposit the plates individually upon the top surface of a rail tie at a zero relative velocity so that the placement is accurate to the required degree of precision.

The machine is adapted for operation as a single or dual rail gang, and further includes a specially adapted one point suspension capable of supporting one side of the machine in the absence of a corresponding rail. The machine is equipped with such suspension on each side to enable operation as a dual rail gang when both rails are removed. Mechanisms are also provided for the removal of unwanted tramp material.

BRIEF DESCRIPTION OF THE DRAWINGS

FIG. 3 is a front perspective view of a conventional rail tie plate;

FIG. 4 is a fragmentary front perspective view of the crawler assembly of the present invention;

FIG. 5 is a fragmentary front perspective view of the break away tramp material device of the present invention;

DESCRIPTION OF THE PREFERRED EMBODIMENT

Figure 2:
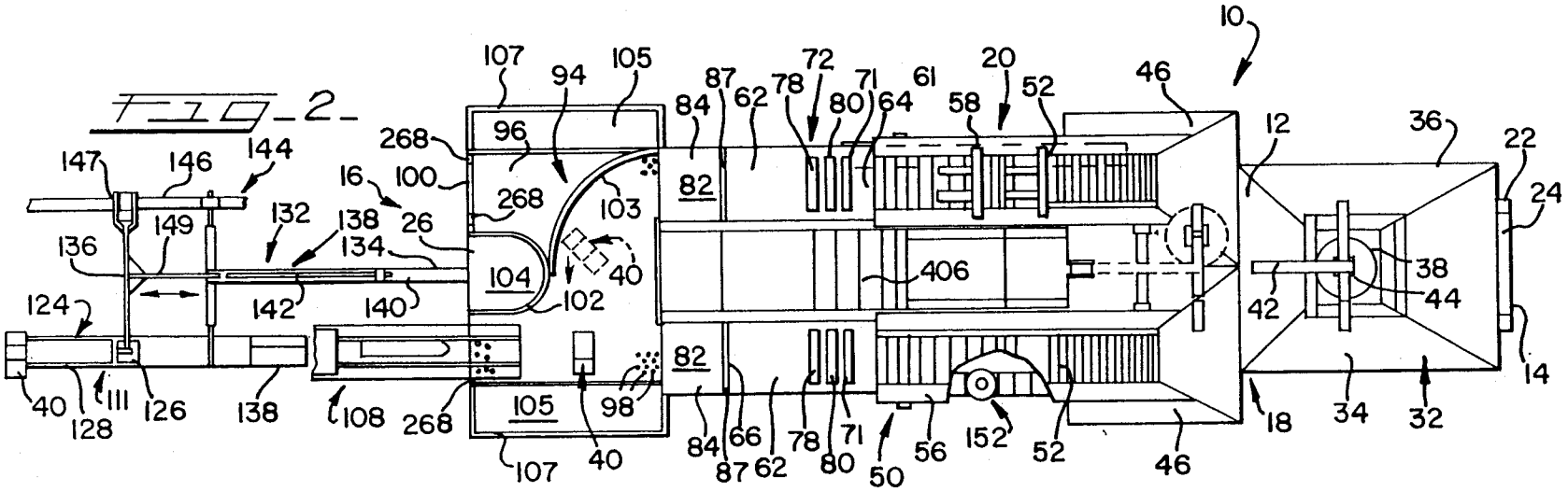
FIG. 2 is a diagrammatic plan view of the machine as depicted in FIG. 1.
Figure 1:
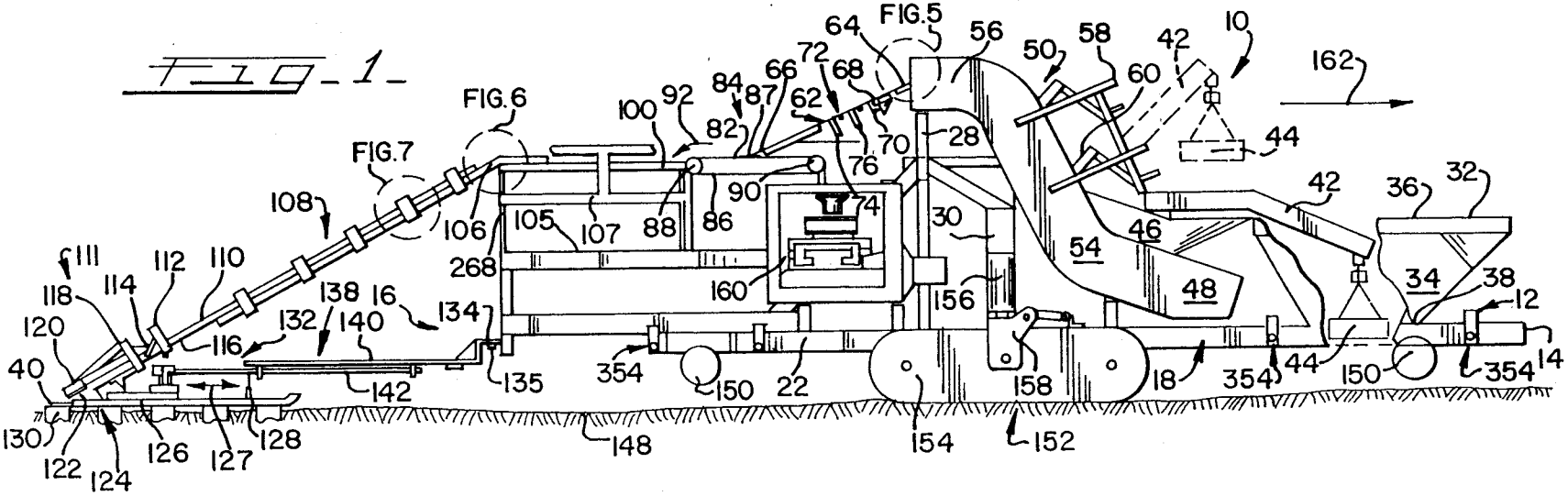
FIG. 1 is a diagrammatic side elevational view of the automatic tie plate setting machine of the invention.

Referring now to the drawings, wherein like reference characters designate identical characteristics, and referring to FIGS. 1 and 2, the automatic rail tie plate setting machine of the invention is depicted and designated generally by reference numeral 10. The machine 10 includes a frame 12 having a front end 14, a rear end 16, and first and second sides 18 and 20 respectively. The frame 12 is provided with a pair of spaced parallel support beams 22, front and rear crossmembers 24 and 26, a pair of central vertical supports 28 and a pair of vertical supports 30. One each of the central vertical supports 28 and vertical supports 30 are located adjacent to a corresponding parallel beam 22. The above-identified support beams, crossmembers and vertical supports are welded to each other to form an integral rigid unit upon which the components of the machine 10 are mounted.

A plate storage hopper 32 is fixed to the front end 14 of the machine 10. The hopper 32 is generally funnel shaped, including four substantially trapezoidal side walls 34, each of the walls being joined together so that the hopper 32 has an upper opening 36 which is substantially larger than that of the bottom 38 of the hopper 32. The hopper 32 is designed to hold approximately 400-500 rail tie plates 40 (best seen in FIG. 3). The hopper 32 is preferably centrally located between the two side support beams 22 so that equal access may be had thereto from either first or second side 18 or 20.

A crane 42 is provided attached to the frame 12 and has an electromagnet 44 suspended therefrom and positioned to retrieve a plurality of plates 40 from the hopper 32. In FIGS. 1 and 2, the crane 42 is shown in a lowered position and the electromagnet is adjacent the bottom 38 of the hopper 32. In addition, the crane 42 and magnet 44 are also shown in phantom in a raised position adjacent a funnel hopper 46, two of which are provided in the preferred embodiment of the machine 10. Each funnel hopper 46 is adapted to receive a supply of plates 40 dropped from the electromagnet 44 and is located at a lower end 48 of an 'S'-shaped rail plate sorting conveyor 50.

The sorting conveyor 50 is provided with an endless belt 52 which travels a path defined by a pair of 'S'-shaped side walls 54 from the lower end 48 to an upper end 56. The belt 52 is provided with a plurality of pockets (not shown) which are each dimensioned to accommodate one plate 40 specified length-to-width orientation, i.e., with a longer side facing the direction of travel of the machine 10. Each side wall 54 has a portion of a rejecter hook support frame 58 mounted thereto approximately midway between the lower end 48 and the upper end 56. The rejecter hook support frame 58 is provided with at least two rejecter hooks 60 mounted for pivotal action thereon and configured to engage plates carried upon the endless belt 52. The structure and operation of the sorting conveyor 50 are described in greater detail in copending application, Ser. No. 203,486.

An inclined conveying surface or ramp 62 having an upper end 64 and lower end 66 is positioned upon the frame 12 so that its upper end 64 is adjacent the upper end 56 of the plate sorting conveyor 50. The ramp 62 is a generally flat piece of sheet steel or other rigid material, having a pair of side walls 63 and the upper end 64 is positioned adjacent the upper end 56 of the plate sorting conveyor 50 so as to be adjacent the endless belt 52 (best seen in FIG. 5).

A rail tie plate orientation sensing apparatus 68 is located near the upper end of the ramp 62. This orientation sensor is designed to distinguish between the upper and lower surfaces of tie plates 40 and is preferably configured as described in commonly assigned U.S. Pat. No. 4,727,989. The orientation sensor 68 is provided with a plurality of pivotal sensor fingers 70 in spaced linear array which are adapted to be in operational relation to the conveyor surface 62 through a transverse opening 71 therein. The sensor 68 includes a logic circuit (not shown) adapted to emit a trigger signal upon the actuation of a specified pattern of the fingers 70. In the preferred embodiment, if a plate is sensed by the fingers as being upside down, a signal is generated by the logic circuit and triggers a plate reorienting mechanism which inverts the plates to the specified top-to-bottom orientation.

Approximately midway down the ramp 62 are located a high speed tie plate reorienting mechanism 72 including a retractable plate stop 74 and a retractable plate flipper mechanism 76. The plate reorienting mechanism also includes a stop panel 78 and a flipper panel 80. The operation of the high speed plate reorienting mechanism 72 is described in detail in commonly assigned application Ser. No. 224,486, entitled "Automatic High Speed Tie Plate Reorienting Mechanism". Basically, upon receipt of the trigger signal from the orientation sensor 68, the plate stop 74 arrests the descent of an inverted plate, and the flipper panel 80 emits a pulse of energy which inverts the plate. After inversion, the plate then continues down the ramp 62.

The lower end 66 of the conveying surface 62 is disposed midway upon an upper span 82 of a buffer conveyor 84. The buffer conveyor 84 includes an endless rubber belt 86 traveling around a pair of spaced rolls 88, 90 and traveling in the direction indicated by the arrow 92. If desired, an impact plate 87 may be disposed at the lower end 66 to protect the belt 86. The roll 88 is disposed adjacent a front edge of a ball transfer table 94.

The ball transfer table 94 includes a perforated top 96 to which are attached a plurality of roller ball transfers 98 (best seen in FIG. 6) disposed in a regularly spaced array so that plates 40 traveling thereacross are provided a low friction conveying surface. The ball transfer table 94 is provided with a vertically projecting retainer wall 100 located around the outer periphery thereof. The retainer wall 100 is designed to prevent the escape of plates 40 from the ball transfer table 94. A cutout portion 102 in the ball transfer table 94 is located in the rear end of the table and defines a work station 104 for an operator who may manipulate the plates as described in greater detail hereinbelow. An arcuate diverter bar 103 is fixed to the table 94 to divert the plates 40 from the buffer conveyor 84 on the side 20 toward the side 18 which, in the embodiment of FIGS. 1 and 2 is the side where the rail plates 40 are being set. The diverter 103 is adjustable and may be moved to the side 18 to divert plates to the side 20 when the opposite rail is being repaired. A scaffold 105 having a railing 107 is located along each side 18, 20 of the frame 12 and adjacent the ball transfer table 94 to provide worker access thereto (best seen in FIGS. 8A and 8B).

Figure 6:
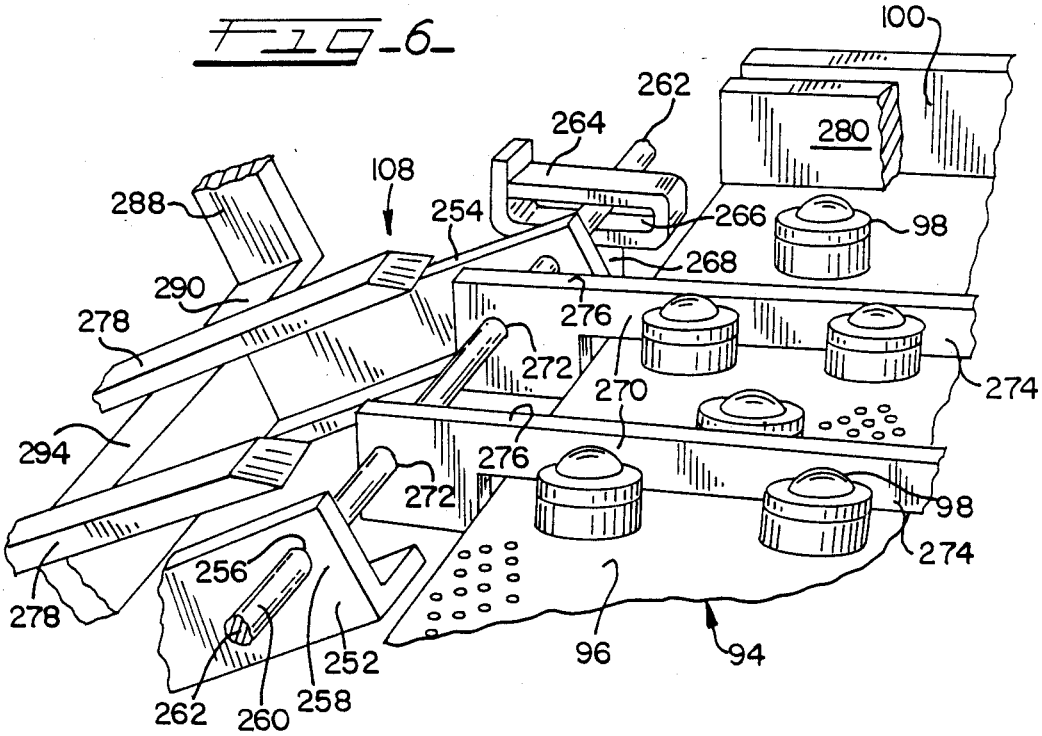
FIG. 6 is a fragmentary front perspective view of the ball transfer table and plate storage rack of the present invention.

At the rear end of the belt transfer table 94 and near the side 18, an upper end 106 of a plate storage rack 108 is pivotably secured (best seen in FIG. 6). The plate storage rack 108 (best seen in FIG. 7) is adapted to receive plates from the ball transfer table 94 and to retain a sufficient supply of properly oriented plates arranged in linear fashion prior to their placement upon the ties. A lower end 110 of the plate storage rack 108 is connected to a rail tie plate setting mechanism 111 as described in co-pending application, Ser. No. 203,328. The plate setting apparatus 111 includes a first plate stack stop 112 having a reciprocating stop member 114 which is adapted to retain a lowermost plate from descending further down an inclined surface 116 which is a continuum of the lower end 110 of the storage rack 108. A plate setter stop 118 is located closely adjacent to the inclined surface 116 below the stack stop 112, and is also provided with a reciprocating stop member (not shown) adapted to engage the lowermost plate upon its release by the stack stop 112 to control its descent down the surface 116.

An electromagnet 120 may be situated at the lower end of the surface 116 and directly above a plate pocket 122 formed in the pusher mechanism, designated generally by the number 124. The pusher mechanism 124 includes a reciprocating plate pusher member 126 which is adapted to reciprocate in linear fashion as indicated by the arrow 127 upon a sled 128 which rides upon the upper surfaces of the ties. The reciprocating action of the pusher member pushes a plate 40 which has been dropped into the pocket 122 upon an upper surface of the rail tie 130.

The plate storage rack 108 and the pusher assembly 124 are supported upon the frame 12 by means of a single rail gang 132 having a front end 134 and a rear end !36. The front end 134 includes a central tongue member 138, the front end of which is adapted to be connected to the rear end 16 of the frame 12 by a locking pin 135. The tongue 138 includes a fixed member !40 which is attached to the frame 12 by the pin 135, and a telescopic member 142 which is adapted to extended linearly in the direction of the rear of the plate setter mechanism 124 to properly adjust the distance of the mechanism 124 in relation to the frame in instances where the plate storage rack 108 is of varying lengths. The rail gang 132 also includes an outrigger wheel assembly 144 adapted to maintain the alignment of the rail gang 132 relative to a rail 146.

An optional rail clamp 147 may be provided to cause the reciprocal action of the pusher member 126. The rail clamp 147 is connected to the pusher member 126 by a 'T'-rod 149 and is adapted to telescope under spring action into the tongue member 138. Thus, the clamp 147, the rod 149 and pusher member 126 moVe as a unit relative to the frame 12.

The frame 12 is adapted to be moved along the rail bed surface 148 or upon the surface of one or both of the rails 146 depending on the condition of the rail bed, i.e., whether it is intact or under repair. In cases where both rails 146 are still disposed upon the rail bed 148, the frame 12 will ride upon the rails using the conventional rail wheels 150, a pair of which are located at the rear end 16 and the front end 14 of the frame 12. However, since the machine 10 of the invention is designed to be utilized in cases where the rail beds are under construction or repair, in most cases either one or both rails 146 will have been removed along with the ties 130, leaving the rail bed 148 as the only surface upon which the machine 10 may travel. In such cases, the machine 10 is provided with a retractable crawler assembly 152.

The crawler tractor assembly 152 includes a conventional crawler unit 154 which is lowered into operation by a fluid power cylinder 156 attached to the vertical support 30 of the frame 12 and which is connected to the crawler unit 154 by means of a suspension member 158. To provide for situations where both rails 146 have been removed, the machine 10 is provided with a crawler tractor assembly 152 on each side 18 and 20 thereof.

Propulsion of the machine is provided by an internal combustion engine 160 which, through hydraulic motors and generators (not shown) powers the crane 42, the electromagnet 44, the conveyor 50, the orientation sensor mechanism 68, the plate stop and flipper mechanisms 74 and 76, the conveyor 84, the stops 112 and 118, the electromagnet 120 and the push-pull mechanism 124. The machine 10 is designed to be propelled down the rail bed in the direction indicated by the arrow 162.

Referring now to FIG. 4, the crawler-tractor assembly 152 and related suspension is shown in greater detail. The crawler unit 154 basically includes a track 164 which is adapted to be disposed around a plurality of conventional tractor wheels (not shown), which receive their driving force from the engine 160. For safety reasons, the track 164 and related wheels are enclosed by a pair of guard plates 166 and 168.

The crawler unit 154 is pivotably mounted to the suspension member 158 by means of the pivot pin 170 which passes through the unit 154 and is retained within the corresponding bores 172 located in each of two depending portions 174 of the suspension member 158. The suspension member 158 also includes a top portion 176 which is engaged by the piston 178 of the fluid power cylinder 156. In the preferred embodiment, the cylinder 156 is a large bore hydraulic cylinder which is fixed to the vertical frame support 30 by means of a bracket 180. The cylinder 156 acts to raise and lower the crawler unit 154 as necessary when the corresponding rail on that side of the frame has been removed. In addition, the cylinder 156 provides a shock absorbing function as the machine 10 is propelled along the track bed 148. The direction of movement provided the crawler unit 154 by the cylinder 156 is indicated by the arrows 181.

The position of the machine 10 in relation to the rail bed 148 is further maintained by means of a telescoping steering stabilizer 182. The steering stabilizer 182 is a generally 'L'-shaped tubular member having a front end 184 provided with a telescoping piston 186 which is pivotably attached by a conventional clevis/pin connection 188 to a crossmember 190 of the frame 12. The tubular body of the stabilizer 182 is fluid filled to provide a shock absorbing function for the crawler unit against stress forces acting on the frame from various directions. The rear end 192 of the stabilizer 182 has a perpendicular sleeve member 194 which is pivotably attached to forwardly projecting ears 196 of the suspension member 158 by means of a pin 197. Additional torsional support is provided by a brace 198.

Referring now to FIGS. 1 and 5, a further feature of the invention is depicted. When plates 40 are provided to the plate storage hopper 32 in random or bulk fashion it is not uncommon for tramp material such as bent or broken spikes, or other steel debris to be incorporated therewith. Thus, when the electromagnet 44 deposits the sample of plates 40 into the funnel hopper 46 for transport and sorting by the sorting conveyor 50, these particles of tramp material may be conveyed along with the oriented plates. When the tramp material reaches the upper end 56 of the conveyor 50, it has a tendency to become lodged between the conveyor and the ramp 62, and may jam the conveyor 50.

Accordingly, the machine 10 includes a tramp material breakaway apparatus, designated generally by the reference numeral 202 as depicted in FIG. 5. The breakaway apparatus 202 is designed to allow tramp material to fall to the ground before it gets to the ramp 62 and as such enlarges a gap 204 between the upper end 56 of the conveyor 50 and the upper end 64 of the surface 62 for the passage of tramp material therethrough. The apparatus 202 basically includes a pair of vertical threaded torsion rods 208 and 210, each of which is fixed at an upper end 212 thereof in a clamp 214, which in turn is secured to a rearwardly projecting member 216. The member 216 is secured to the upper end 56 of the conveyor 50. A threaded bolt 218 and lock nut 220 provide clamping force to secure the rods 208 and 210 within the clamp 214.

The upper end 206 of the ramp 62 is provided with a transverse shaft 222 which is secured to the underside of the ramp 62 and projects laterally beyond each side end of the ramp 62. Each end of the shaft 222 is designed to engage a barrel 224 located on each vertical rod 208, 210. The position of the barrels 224 upon the rods 208, 210 is maintained by upper and lower jam nuts 226, 228, respectively, which are each jammed against the respective ends of the barrel 224. Thus, the barrels 224 are adjusted on the rods 208, 210 so that the ramp 62 is fixed relative to the conveyor belt 52 so as to properly receive sorted plates from the conveyor 50. This position of the ramp 62 may be altered by vertically adjusting the barrel 224 and relocking the jam nuts 226, 228.

A lower end 230 of each rod 208, 210 is formed into an eyelet 232. A compression spring 234 is secured at one end thereof to each eyelet 232 and at an opposite end thereof to the sorting conveyor 50. A stop bushing 236 is slid over each rod 208 and 210 and rests just above the eyelet 232 where it is restrained by a stop means such as a locking pin 238. The stop bushing 236 is designed to be adjustably vertically positioned on the rods 208, 210 by means of an adjusting sleeve 240 and a jam nut 242. The exact position of the bushing 236 may be adjusted by providing sleeves 240 of varying lengths. The bushing 236 is adapted to contact a threaded stop member 244 which projects rearwardly from the sorting conveyor 50. The stop member 244 is provided with a threaded shank 246 which threadably engages the conveyor 50 and is adjustably locked thereto by a jam nut 248. A head portion 250 of the stop member 244 may be configured to conform to the outer configuration of the stop bushing 236 so as to provide a positive seat thereagainst.

In operation, should tramp material be carried on the belt 52 of the conveyor 50, when it approaches the gap 204 and before it becomes lodged therein, the pressure exerted by the tramp material in the gap 204 between the belt and the ramp 62 will cause a force which overrides the biasing force provided by the springs 234. Thus, the ramp 62 will be pushed rearwardly away from the conveyor 50 until the tramp material falls through the gap 204. Once the tramp material has passed, the springs 234 draw the inclined conveying surface 62 back to its proper position relative to the conveyor 50. It will be appreciated that the rods 208, 210 are long enough to have a certain amount of resiliency so as to accommodate the torsion effect caused by the passage of tramp material through the gap 204.

As the machine 10 travels down the rail bed 148 in the direction 162, irregularities in the surface of the bed require that the plate storage rack 108 and the plate pusher mechanism 124 be relatively freely attached to the frame 12 to prevent misalignment of these components relative to each other. This junction between the plate storage rack and the frame 12 is shown in greater detail in FIG. 6.

Referring now to FIG. 6, the plate storage rack 108 includes a pair of spaced, parallel elongate side bars 252 and 254. In the preferred embodiment, the side bars 252 and 254 are provided as conventional 'L'-members. An upper end 258 of each side bar 252, 254 is provided with a transverse bore 256 which is dimensioned to accommodate a transverse pivot rod 260.

Each end 262 of the pivot rod 260 is inserted into a bracket 264 having an elongate slot 266 therein. The bracket 264 is secured to a vertical support 268 which is fixed to the rear end 16 of the frame 12. The elongate configuration of the slot 266 allows the plate support rack 108 to move forward, backward as well as along an angle relative to the direction of travel 162 of the machine 10 so as to maintain operational engagement with the ball transfer table 94 while the machine 10 travels over the irregular rail bed surface 148. Two pairs of vertical supports 268 are located on the rear end 16 of frame 12 to enable the attachment of a plate storage rack 108 on either or both the sides 18, 20. Thus, plate setting may be carried out for either or both rails 146.

In order to facilitate the rapid transfer of plates 40 from the ball transfer table 94 into the storage rack 108, the transverse rod 260 is provided with at least two transfer bars 270. Each transfer bar 270 is provided with a transverse pivot bore 272 which slidingly accommodates the transverse rod 260. The movement of the transfer bars 270 axially on the shaft 260 is restricted only in that an elongate portion of the transfer bar 274 is laid upon the table top 96 between adjacent ball transfers 98 which prevent the lateral movement of each bar 270. Each bar 270 is also provided with an upper surface 276 upon which the tie plates 40 slide as they are transferred from the ball transfers 98 to the upper surfaces of a pair of elongate slide bars 278. The slide bars 278 are fixed in spaced parallel relationship to each other upon the plate storage rack 108 and extend substantially the entire length thereof.

A gaging plate 280 is also located upon the top surface 96 of the ball transfer table 94 and is placed in spaced relationship from a portion of the peripheral wall 100 which defines the cutout portion 102. The distance from which the gaging plate 280 is located from the wall 100 is determined by the dimensions of the particular plate 40 being set. The gaging plate 280 allows the operator to orient the plate properly as to its high side-to-low side dimensions (described in further detail hereinbelow) for placement upon the plate storage rack 108. The elongate slide bars 278 are spaced on the plate storage rack 108 to provide a low friction conveying surface for plates which are stored seriatim upon the rack 108. The bars 278 are preferably disposed so that the transfer bars 270 are located therebetween.

Figure 7:
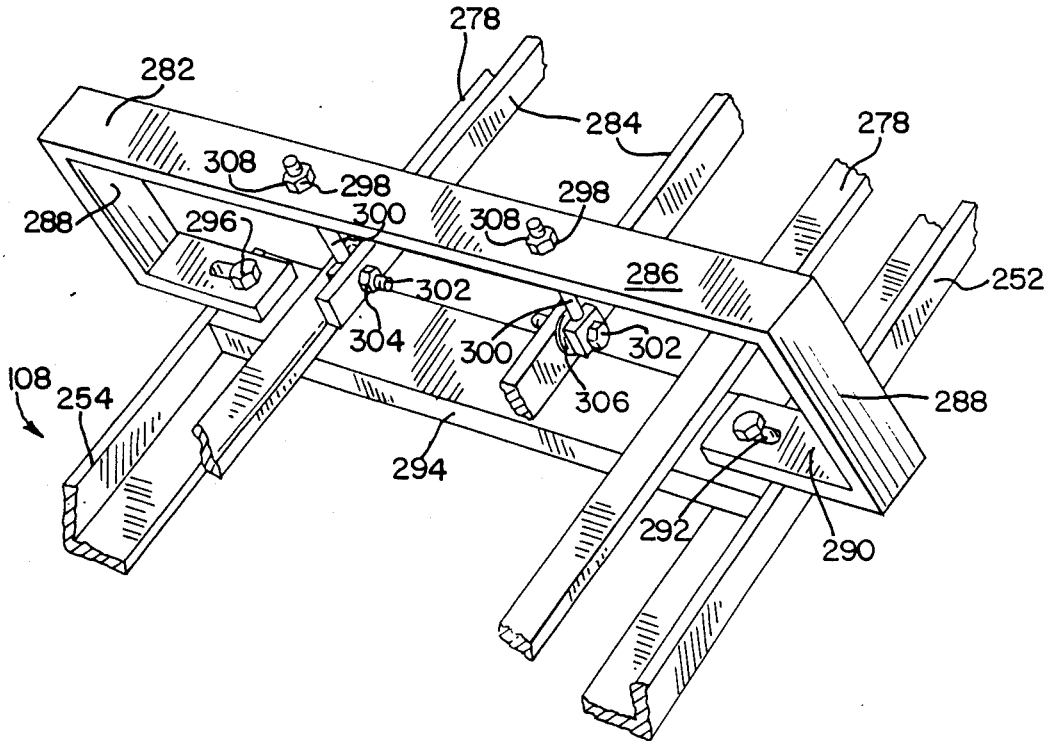
FIG. 7 is a fragmentary front perspective view of the plate storage rack of the invention.

Referring now to FIGS. 1, 6 and 7, the plate storage rack 108 is further provided with a plurality of shoe mounting brackets 282 which are placed in equally spaced relationship to each other along the entire length of the bracket 108. The purpose of the brackets 282 is twofold, that being to provide rigidity to the rack 108 which, when it is filled with plates 40, may weigh as much as 1,000 pounds, and has a tendency to sag midspan, thus preventing proper sliding action of the plates thereon. A second purpose of the brackets 282 is to provide a mounting point for the elongate top shoes 284 which also extend substantially the length of the rack 108. The shoe mounting bracket 282 has an upper horizontal member 286, a pair of vertical supports 288 and a pair of lower inwardly projecting portions 290. Each portion 290 is provided with an elongate mounting slot 292 by which the bracket 282 is secured to one of a plurality of crossmembers 294 spaced along the plate storage rack 108. The bracket 282 is secured to the crossmember 294 by means of bolts 296 which pass through the slots 292. The slots 292 enable the lateral movement of the bracket 282 upon the crossmember 294 to accommodate variations in plate configuration. It will be evident that the slide bars 278 are secured to each of the crossmembers 294.

The upper member 286 of the mounting bracket 282 includes a pair of spaced bores 298, each of which is designed to accept a respective latch bolt 300, designed to depend therefrom towards the crossmember 294. The latch bolt 300 is secured to the top shoes 284 by a bolt 302 having a nut 304. A plurality of flat washers or spacers 306 are interposed between the latch bolt 300 and the top shoe 284 to enable the adjustment of the spacing of the top shoes relative to each other so as to accommodate plates of varying sizes. The latch bolts 300 are retained upon the bracket by appropriate lock nuts 308.

Figure 8A:
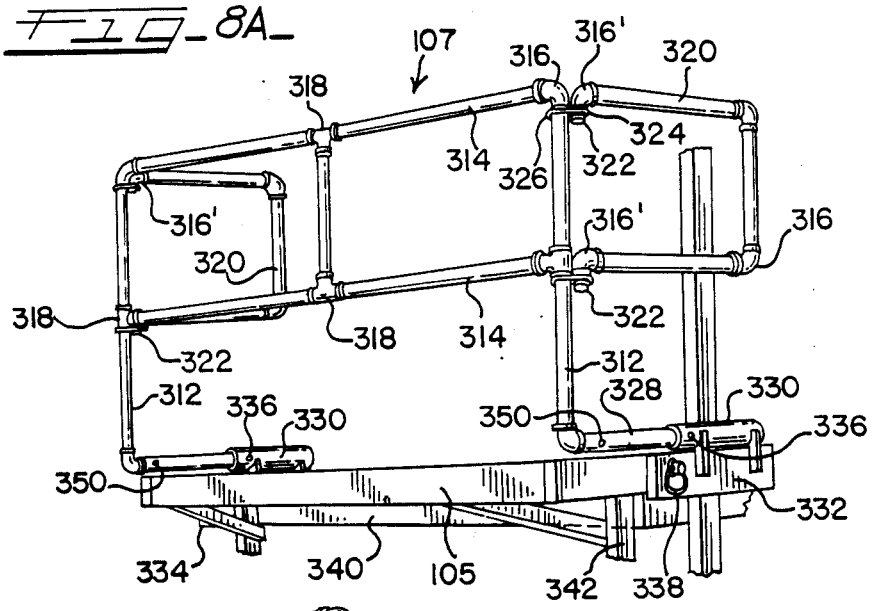
FIG. 8A is a fragmentary front perspective view of the scaffold of the invention shown in the operational position.
Figure 8B:
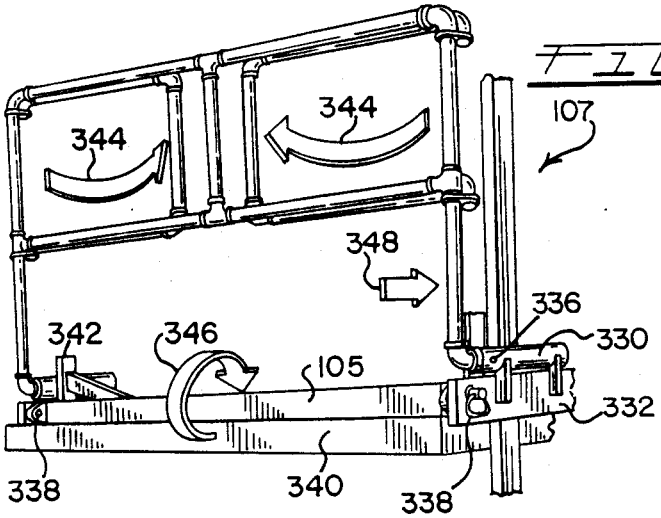
FIG. 8B is a fragmentary front perspective view of the scaffold of FIG. 8A shown in the retracted position.

Referring now to FIGS. 1, 8A and 8B, the safety scaffold 105 of the machine 10 is illustrated. During normal operation of the machine 10, one operator would be positioned at the work station 104 in order to properly orient the plates 40 against the gaging plate 280 prior to their placement in the plate storage rack 108. However, in some instances such as when plates become jammed upon the ball transfer table 94 or when maintenance is required during operation of the machine 10, it may be necessary for additional operators to be positioned upon the scaffold 105. In such instances the railing 107 will be provided to prevent operators from falling from the scaffold 105. When it is necessary to transport the machine 10 long distances between sites, the additional width provided by the scaffold 105 and railing 107 will not permit adequate clearance for the machine for transport on public highways or railroad track. Thus, a mechanism has been devised to retract the platform 105 and railing 107.

Referring now to FIGS. 8A and 8B, the railing 107 includes a pair of vertical supports 312 and a pair of main horizontal supports 314. The supports 312 and 314 are fabricated from sections of tubular pipe and are joined together to form a generally rectangular integral shape by a plurality of conventional elbow joints 316 and T-joints 318. A pair of pivotal wing portions 320 fabricated of similar construction as the main portion of the railing 107 are pivotably mounted to each vertical support 312 by insertion of a depending portion 322 of elbow joints 316' into appropriate openings 324 in specially designed brackets 326 attached to the vertical supports 312. Each vertical support 312 is further provided at its lower end with a telescoping member 328 which is designed to be slidably journaled into a receiving tube 330. The receiving tubes 330 are each fixed to respective crossmembers 332, 334 of the frame 12. The railing 107 is held in the extended position (shown in FIG. 8A) by a bolt 336 passing through the tube 330 and the member 338.

The scaffold 105 is also provided with a releasable pivot pin 338 which secures the scaffold against a beam 340 of the frame 12. A pair of vertical stops 342 are positioned to depend from the underside of the scaffold 105 so as to engage the beam 340 when the scaffold 105 is in its extended position as shown in FIG. 8A.

When the machine 10 is prepared for transport, and referring now to FIG. 8B, the wing portions 320 are pivoted inwardly in the direction indicated by the arrows 344. Next, the pins 338 are removed, allowing the platform 105 to be pivoted in the direction indicated by the arrow 346. In this position, the stops 342 are now shown projecting upwardly. In addition, the bolts 336 are removed from the receiving tubes 330 and the telescoping members 328 are pushed into the tubes 330 in the direction indicated by the arrow 348. The telescoping members 328 are then secured within the tubes 330 by means of the bolts 336 which are then inserted through bores 350 (best seen in FIG. 8A) located in each telescoping member 328. Thus, the railing 107 and the scaffold 105 are made flush with the sides 18, 20 of the machine 10.

Figure 9:
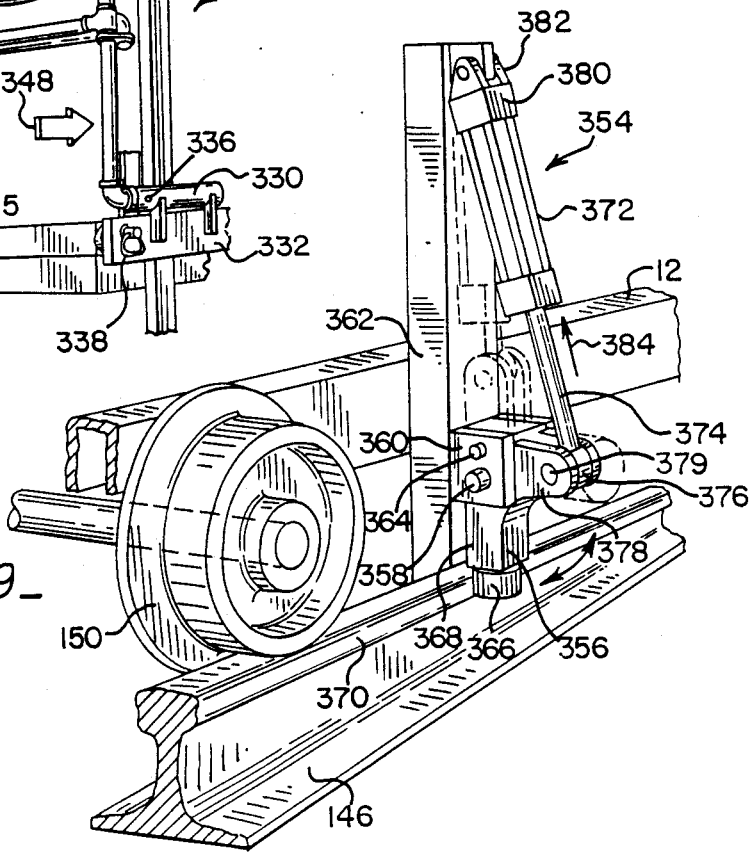
FIG. 9 is a fragmentary perspective view of the machine of the invention showing the retractable bogey wheel.

Referring now to FIG. 9, due to its considerable length, when the machine 10 is being propelled across a conventional railroad crossing where the rails are interrupted to allow the passage of an intersecting rail, there is a significant potential for derailment. This is a particular problem where one of the rails 352 is removed for repair. If the alignment of the machine 10 on the remaining rail 146 were maintained solely by the wheels 150, derailment of the machine would be quite likely upon any lateral movement of the machine. Accordingly, the machine 10 is provided with a plurality of bogey wheel assemblies 354 which are designed to maintain the alignment of the machine against the rail.

Each bogey wheel assembly 354 includes an 'L'-shaped pivot body 356 which is adapted to be pivotal about a transverse pin 358 located in a U-bracket 360 which is fixed to a vertical support 362 of the frame 12.

In its extended position (shown in solid lines in FIG. 9), the pivot body 356 is secured against pivot action by a removable locking pin 364. A bogey wheel 366 is attached to a lower end 368 of the pivot body 356 for axial rotation thereabout. As seen in FIG. 9, when the pivot body 356 is in the lowered or extended position, the bogey wheel 360 will engage the outer load edge 370 of the rail 146. The pivot body 356 is supported in the extended position by a fluid power cylinder 372 having a piston shaft 374. The free end 376 of the shaft 374 is pivotably connected to an open ended clevis 378 in the pivot body 356 by a pin 379. An upper end 380 of the cylinder 372 is provided with a similar clevis and pin assembly 382 to enable the cylinder to be pivotably engaged to the vertical support 362. In the preferred embodiment, four such bogey wheel assemblies are mounted to each side 18, 20 of the machine 10.

Once the machine 10 has passed the rail crossing and may resume normal plate setting operation without the danger of derailment, the bogey wheels 366 may be retracted. When it is desired to retract the bogey wheels, the locking pin 364 is removed, and the piston shaft 374 of the cylinder 372 is retracted in the direction indicated by the arrow 384 until the pivot body is in the position indicated in phantom in FIG. 9.

Prior to discussing the operation of the machine 10, it is advisable to review the structure of the rail tie plates to be set by the machine. Referring now to FIG. 3, the typical rail tie plate 40 includes a substantially planar body 386 and has a flat bottom 388, a pair of longer sides which will be designated the front and rear 390 and 392, a shorter pair of parallel side ends 394 and 396. It will be evident from FIG. 3, that the "high" side 396 also known as the "field side", is higher or taller than the "low" side 394. This is so that the plate 40 will have more mass on the field side to accommodate the force distribution generated by trains negotiating curves at high speeds. The upper surface 398 of the plate 40 is provided with a pair of spaced, parallel upwardly projecting shoulders 400 which define between them a canted rail seat 402. The plate 40 is also provided with a plurality of spike holes 404 at each end 394 and 396 thereof to permit the plates 40 to be secured to upper surfaces of rail ties 130 (best seen in FIG. 1).

In operation, the machine 10 is adapted to be driven down the rail bed 148 in the direction 162. An operator designated the driver is positioned approximately at point 406 and controls the velocity of the machine as well as the operation of the crane 42, and at least one operator is positioned at the work station 104 to properly manipulate the plates 40 as they come along the ball transfer table 94 for high side-to-low side orientation and for placement upon the plate storage rack 108. Prior to setting of tie plates, the storage hopper 34 is filled with randomly arrayed tie plates. The first operator then lowers the crane 42 and its corresponding electromagnet 44 into the storage hopper 34 to retrieve a supply of plates. The crane 42 is then manipulated so that the electromagnet is directly over the funnel hopper 46. The electromagnet 44 is then released, thus dropping a supply of plates 40 at the base of the plate sorting conveyor 50.

Through the operation of the moving endless belt 52, the plates 40 are sorted into proper length-to-width arrangement, since the plates 40 will only fit in the pockets of the belt 52 with the long dimensions 390, 392 facing the front 14 and/or rear 16 of the machine 10. Should plates be carried by the endless belt which are not properly oriented within the pockets, they are rejected by the pivoting rejecter hooks 60 and returned to the funnel hopper 46 at the bottom of the conveyor 50.

Plates which are properly oriented within the pockets of the belt 52 eventually reach the upper end 56 of the plate sorting conveyor 50 and are then transferred to the ramp 62. Should there be any tramp material in the pocket accompanying the plate, that tramp material is released by the breakaway apparatus 202 and falls through the gap 204 (best seen in FIG. 5). Once the plates reach the inclined conveying surface 62, they are in proper length-to-width orientation through the action of the conveyor 50. However, some of the plates may still be improperly oriented as to top-to-bottom orientation as they slide down the inclined surface 62. This orientation of the plates is sensed by the plate orientation sensor 68. Should the plates be inverted, i.e., with the shoulders 400 facing downward, the fingers 70 of the orientation sensor 68 will trigger the stop and flipper mechanisms 74 and 76 to invert the plate to its proper position with the flat side 388 facing down. The plates 40 then progress down to the lower end 66 of the inclined surface 62, where they engage the buffer conveyor 84. The function of the buffer conveyor 84 is to slow the velocity of the plates coming off of the inclined surface 62 and prepare them to be manipulated upon the ball transfer table 94.

In the embodiment pictured in FIGS. 1 and 2, the machine 10 of the invention is adapted for single rail plate setting at rates of at least 40 plates per minute. Thus, two sorting conveyor, stop/flipper and buffer conveyor systems are provided to feed plates into a single plate storage rack 108. In such cases, the diverter bar 103 is positioned so that the plates 40 coming off of both buffer conveyors 82 will be channelled into the area adjacent the plate storage rack 108. Should the machine be assigned to set plates for the opposite rail, the diverter bar 103 is slid across the table top 96 toward the side 18, and the flow of plates from both conveyors 82 will be funnelled to the opposite side 20 of the machine 10. Should the machine 10 be adapted for dual rail operation, two storage racks 108 and pusher assemblies 111 would be provided and the diverter bar 103 would be removed.

Returning now to FIGS. 1 and 2, once the plates reach the ball conveyor table 94, they are already properly oriented as to length-to-width and top-to-bottom. However, they are not properly oriented high side-to-low side, which will be necessary for their proper placement upon the rail tie 130. Thus, an operator working at work station 104 manually manipulates the plates 40 against the gaging bar 280 (best seen in FIG. 6) so that the high side 398 is away from the operator and facing the side 18. This is the only position in which the plates 40 will properly enter the rack 108, for proper alignment is required so that the top shoes 284 slidingly engage inner surfaces of the plate shoulders 400 and the slide bars 278 slidingly engage the plate bottoms 388. If desired, the plates 40 may alternatively be held within the rack 108 along their side ends 394, 396.

The operator then manipulates the plates across the surfaces 276 of the transfer bars 270 and upon the slide bars 278. The plates 40 travel down the storage rack 108 until they are stopped by the first plate stacking stop 112. As plates are manipulated by the operator, they are stored seriatim in the plate storage rack prior to deposition upon the ties. During normal operation, the rack 108 will be filled with plates 40.

When the setting is to begin, upon the sensing of a rail tie the plate pusher mechanism 124 releases the stop 112 so that one plate is released and impacts the setter stop 118. The plate setter stop 118 then releases the plate down the surface 116 until it reaches the electromagnet 120. The electromagnet 120 holds the plate until it is deposited into the pocket 122 of the plate setter mechanism 124. At the appropriate time, the reciprocating plate pusher member 126 pushes the plate 40 off of the rear end of the sled 128. The forward velocity of the machine 10 in relation to the rearward pushing velocity exerted by the pusher member 126 cancel each other out so that the plate 40 is deposited upon the tie 130 at a zero relative velocity. Thus, the plate will not significantly move from its designated location on the rail tie. The plate setting sequence is synchronized to achieve a plate setting rate of at least 40 plates per minute using a single rail gang as depicted in FIG. 2, or at least 20 plates per minute if a dual rail gang is employed.

When the plate setting operation is completed, the railing 107 will be retracted, the plate storage rack 108 and plate setting assembly 111 may be removed by removing the pivot shaft 260 and the pin 135, and the crawler tractor assembly 152 may be retracted. The machine 10 may then be easily placed upon a suitable flat bed trailer for transport by truck to a designated site.

While particular embodiments of the rail tie plate setting machine of the invention have been described, it will be obvious to persons skilled in the art that changes and modifications might be made without departing from the invention in its broader aspects and as set forth in the following claims.

What is claimed is:

1. An automatic machine for setting rail tie plates, comprising:

a frame having two sides and adapted to travel along a railroad track bed;

a hopper means secured to said frame for storing a plurality of randomly oriented plates;

sorting means secured to said frame and adapted to receive the randomly oriented plates from said hopper means and to automatically sort the plates as to a specified length-to-width orientation regardless of their orientation upon receipt from said hopper means;

sensing means located on said frame and adapted to sense the orientation of the sorted plates as to a specified top-top-bottom orientation;

reorienting means located on said frame and adapted to be triggered by said sensing means for properly reorienting the sensed inverted plates as to a specified top-to-bottom orientation;

means located on said frame for receiving the plates from said reorienting means and for enabling the slidable manipulation of the oriented plates as to a specified high side-to-low side orientation; and setting means on said frame adapted to receive the oriented plates from said high-side to low-side orientation means and to automatically set the oriented plates individually upon an upper surface of each of a plurality of rail ties.

2. The machine as defined in claim 1 wherein said frame further includes traction means adapted to support said machine for operation and movement on either of said sides of said frame where a rail has been removed.

3. The machine as defined in claim 2 wherein said traction means is at least one crawler assembly.

4. The machine as defined in claim 3 wherein said crawler assembly includes a suspension assembly having a crawler unit attached thereto.

5. The machine as defined in claim 4 wherein said suspension assembly is adapted so that said crawler unit may be pivotally secured to said frame to maintain said frame in a generally parallel position relative to the railroad track bed.

6. The machine as defined in claim 5 wherein said suspension assembly includes a fluid pressure cylinder secured to said frame and having a piston extending from a lower end of said cylinder for reciprocal operation, said piston being secured at a lower end thereof to a suspension member, said crawler unit being pivotally secured to said suspension member, said suspension member also being connected to said frame by a steering stabilizer member.

7. The machine as defined in claim 5 wherein said crawler assembly is adapted to be powered by drive means.

8. The machine as defined in claim 1 wherein said frame is provided with a plurality of retractable bogey wheels mounted in regularly spaced relationship to each other on each of said sides.

9. The machine as defined in claim 1 wherein said hopper means includes a hopper adapted to store a plurality of plates and means for transporting several of the plates to said sorting means.

10. The machine as defined in claim 9 wherein said transporting means is a crane equipped with an electromagnet.

11. The machine as defined in claim 1 wherein said sorting means includes at least one plate sorting conveyor adapted to receive randomly oriented plates and to properly sort the plates as to a specified length-to-width orientation, with a longer front or rear end of each of the plates facing a rear end of said frame.

12. The machine as defined in claim 11 wherein said at least one plate sorting conveyor includes a plate storage container, an endless conveyor belt adapted to accommodate only plates which are properly oriented in said specified length-to-width orientation, and a rejecter mechanism to prevent the conveyance of improperly oriented plates, said conveyor adapted to transport the properly oriented plates to said sensing means.

13. The machine as defined in claim 1 wherein said plate sensing means includes at least one inclined conveyor surface having upper and lower ends, a plate orientation sensing mechanism associated with said surface and including a plurality of pivotal sensor fingers located at said upper end of said surface, said fingers being disposed in operative relationship to said surface and connected to logic means adapted so that one of the plates sliding upon said surface past said fingers and having improper top-to-bottom orientation will trigger a specified pattern of tripped fingers which will emit a trigger signal to said reorienting means.

14. The machine as defined in claim 13 wherein said reorienting means includes a retractable stop member adapted to stop the transit of an inverted plate on said inclined conveyor surface in response to said signal from said plate sensing means, and a retractable flipper member adapted to exert an impulse of energy to the stopped plate to invert and place the plate in proper top-to-bottom orientation on said surface.

15. The machine as defined in claim 13 wherein said sorting means is a sorting conveyor having an upper end disposed in closely spaced relationship to said conveyor surface so as to feed the plates to said conveyor surface, and said machine further includes a tramp material release mechanism located at said upper end of said sensing means and said upper end of said sorting conveyor.

16. The machine as defined in claim 1 wherein said high side-to-side orientation means includes a low-friction conveyor surface, said low-friction conveyor surface being provided with guide means configured so that plates may be manually positioned thereagainst in said specified high side-to-low side orientation.

17. The machine as defined in claim 16 wherein said low-friction conveyor surface is a ball transfer table having a plurality of ball transfers mounted thereon.

18. The machine as defined in claim 17 wherein said ball transfer table is provided with an arcuate diverter bar.

19. The machine as defined in claim 18 wherein said diverter bar is movable to either side of said frame.

20. The machine as defined in claim 17 wherein said high side-to-low side orientation means includes a gaging plate located on said ball transfer table.

21. The machine as defined in claim 1 wherein said setting means includes at least one inclined plate storage rack having an upper end and a lower end, said upper end connected to said high side-to-low side orientation means for receiving reoriented plates therefrom, said setting means further including stack stop and setting stop assemblies adapted to stop and selectively release the reoriented plates seriatim, and at least one sled located at a lower end of said rack and having a reciprocating plate pusher assembly.

22. The machine as defined in claim 21 wherein said upper end of said plate storage rack is pivotally mounted to said frame.

23. The machine as defined in claim 21 wherein said plate storage rack is provided with a plurality of regularly spaced, adjustable shoe mounting brackets, and at least two generally parallel elongate slide bars.

24. The machine as defined in claim 23 wherein said plate storage rack is provided with a pair of elongate shoes laterally adjustably mounted to an upper member of each of said shoe mounting brackets in substantially spaced parallel relationship to each other.

25. The machine as defined in claim 22 wherein said upper end of said pivotal plate storage rack is provided with transfer means to facilitate the transfer of the plates from said high side-to-low side orientation means to said plate storage rack.

26. The machine as defined in claim 25 wherein said transfer means includes at least one transfer bar pivotally mounted at a first end thereof to said frame, and projecting upon said high side-to-low side orientation means at a second end thereof.

27. The machine as defined in claim 21 wherein said lower end of said plate storage rack is provided with an electromagnet designed to retain individual plates prior to the deposition thereof to said plate pusher assembly.

28. The machine as defined in claim 21 wherein said plate pusher assembly is provided with a single rail gang guide assembly.

29. An automatic rail tie plate setting machine comprising:

a frame having a front end, a rear end, two sides and being adapted to travel along a rail track bed;

a plate storage hopper mounted at the front end of said frame and adapted to store a plurality of rail tie plates;

means for transferring several of the plates from said hopper to a sorting conveyor;

a plate sorting conveyor having two sides and adapted to receive the plates from said transfer means and to sort said plates in a specified length-to-width orientation;

an inclined conveyor ramp adapted to receive the sorted plates from said plate sorting conveyor and having plate orientation sensing means and plate reorienting means, said orientation sensing means adapted to sense the top-to-bottom orientation of the plates, and, upon sensing improperly oriented plates, to trigger said reorienting means to invert the improperly oriented plates; and a tramp material breakaway apparatus connected to said sorting conveyor and said ramp and adapted to prevent the transmission of tramp material down said ramp.

30. The machine as defined in claim 29 wherein said means for transferring several of the plates is a crane having an electromagnet.

31. The machine as defined in claim 29 wherein said rail sorting conveyor includes an endless belt and a plurality of rejecter hooks adapted to engage said belt and reject improperly oriented plates therefrom.

32. The machine as defined in claim 29 wherein said tramp material breakaway apparatus includes a pair of vertical rods secured at upper ends thereof to each said side of said sorting conveyor and depending therefrom so as to engage respective sides of said ramp.

33. The machine as defined in claim 32 wherein said ramp is provided with a transverse shaft secured at an upper end of an underside of said ramp, said shaft having two ends, each of which is adapted to engage a respective vertical rod.

34. The machine as defined in claim 33 wherein the position of said shaft on said rods is adjustable.

35. The machine as defined in claim 32 wherein said breakaway apparatus further includes biasing means connecting lower ends of each of said rods to said conveyor so as to bias said lower rod ends toward said conveyor, and stop means to control the position of said rods relative to said conveyor.

36. The machine as defined in claim 34 wherein said biasing means is a compression spring.

37. An automatic rail tie plate setting machine comprising:

a frame having a front end, a rear end, two sides and being adapted to travel along a rail track bed;

a plate storage hopper adapted to retain a plurality of randomly assorted rail tie plates;

means for transferring the plates from said hopper to a plate sorting conveyor;

said plate sorting conveyor adapted to receive the plates from said hopper and to sort the plates into specified length-to-width orientation;

an inclined conveyor ramp adapted to receive the sorted plates from said sorting conveyor and having sensing means for sensing the top-to-bottom orientation of the plates and reorienting means for reorienting improperly oriented plates;

a low friction conveyor table to receive plates from said conveyor ramp and adapted so that the plates may be manipulated as to specified high side-to-low side orientation;

a plate storage rack adapted to receive the orientated plates from said low friction conveyor and to store the plates in linear fashion; and a plate setter assembly having a stop means and reciprocating pusher means adapted to receive individual plates from said storage rack and to place each of the plates upon a respective tie at a zero velocity.

38. The machine as defined in claim 37 further including a scaffold and a railing disposed on either side of said frame adjacent said low friction table.

39. The machine as defined in claim 38 wherein said scaffold and railing are retractable.

40. The machine as defined in claim 37 wherein said plate storage rack and said plate pusher assembly are detachable from said frame for transport.

41. A method for automatically setting rail tie plates upon the ties of a railroad track, comprising:

providing a frame adapted to travel along a railroad track bed;

storing a plurality of said plates upon said frame;

automatically sorting said plates on said frame as to specified length-to-width orientation for at least one rail;

automatically sensing said sorted plates on said frame as to their top-to-bottom orientation;

automatically inverting said sensed plates which are sensed to have improper top-to-bottom orientation;

manipulating said sensed and inverted plates as to a specified high side-to-low side orientation; and setting said oriented plates upon an upper surface of said ties.

42. The method as defined in claim 41 further including providing tramp material release means for said sorted plates.

43. The method as defined in claim 41 further including storing said oriented plates prior to setting thereof upon said ties.

* * * * *